US011328705B2

(12) United States Patent
Hua et al.

(10) Patent No.: US 11,328,705 B2
(45) Date of Patent: May 10, 2022

(54) NOISE-REDUCTION PROCESSING METHOD AND DEVICE, AND EARPHONES

(71) Applicant: GOERTEK TECHNOLOGY CO., LTD., Shandong (CN)

(72) Inventors: Yang Hua, Shandong (CN); Peng Li, Shandong (CN)

(73) Assignee: GOERTEK TECHNOLOGY CO., LTD., Shandong (CN)

( * ) Notice: Subject to any disclaimer, the term of this patent is extended or adjusted under 35 U.S.C. 154(b) by 0 days.

(21) Appl. No.: 15/733,648

(22) PCT Filed: Aug. 14, 2018

(86) PCT No.: PCT/CN2018/100366
§ 371 (c)(1),
(2) Date: Sep. 24, 2020

(87) PCT Pub. No.: WO2019/210605
PCT Pub. Date: Nov. 7, 2019

(65) Prior Publication Data

US 2021/0104219 A1 Apr. 8, 2021

(30) Foreign Application Priority Data

May 4, 2018 (CN) ..... 201810421059.6

(51) Int. Cl.
*G10K 11/178* (2006.01)
*G10L 25/18* (2013.01)
(Continued)

(52) U.S. Cl.
CPC ..... *G10K 11/17881* (2018.01); *G10L 25/18* (2013.01); *G10L 25/21* (2013.01);
(Continued)

(58) Field of Classification Search
CPC ..... G10K 11/17881; G10K 2210/1081; G10K 2210/3012; G10K 2210/3026;
(Continued)

(56) References Cited

U.S. PATENT DOCUMENTS

2014/0126734 A1* 5/2014 Gauger, Jr. ..... H04R 1/1083 381/71.6
2018/0122359 A1 5/2018 Liu et al.

FOREIGN PATENT DOCUMENTS

CN 101026362 A 8/2007
CN 101267189 A 9/2008
(Continued)

*Primary Examiner* — David L Ton
(74) *Attorney, Agent, or Firm* — LKGlobal | Lorenz & Kopf, LLP

(57) ABSTRACT

A method and device for noise-reduction processing and an earphone are disclosed. The method includes: collecting an environmental-sound signal by using a feedforward microphone to acquire amplitude information and spectrum information of the environmental-sound signal; performing feedforward noise-reduction processing on the environmental-sound signal according to the amplitude information of the environmental-sound signal, and extracting a sound signal having a specified frequency in the environmental-sound signal according to the spectrum information of the environmental-sound signal; and outputting the sound signal having the specified frequency together with the signal after being feedforward noise-reduction processed. The present disclosure can realize the monitoring of the valuable sound signal having a specified frequency in the environmental-sound signal.

12 Claims, 2 Drawing Sheets

(51) Int. Cl.
*G10L 25/21* (2013.01)
*G10L 25/48* (2013.01)

(52) U.S. Cl.
CPC ..... *G10L 25/48* (2013.01); *G10K 2210/1081* (2013.01); *G10K 2210/3012* (2013.01); *G10K 2210/3026* (2013.01); *G10K 2210/3027* (2013.01); *G10K 2210/3056* (2013.01)

(58) Field of Classification Search
CPC .... G10K 2210/3027; G10K 2210/3056; G10L 25/18; G10L 25/21; G10L 25/48
See application file for complete search history.

(56) References Cited

FOREIGN PATENT DOCUMENTS

| | | | |
|---|---|---|---|
| CN | 101404160 | A | 4/2009 |
| CN | 101800520 | A | 8/2010 |
| CN | 102356426 | A | 2/2012 |
| CN | 104581519 | A | 4/2015 |
| CN | 104602163 | A | 5/2015 |
| CN | 104616662 | A | 5/2015 |
| CN | 105723458 | A | 6/2016 |
| CN | 106231491 | A | 12/2016 |
| CN | 106340303 | A | 1/2017 |
| CN | 106910492 | A | 6/2017 |
| CN | 107517415 | A | 12/2017 |
| CN | 107945815 | A | 4/2018 |
| JP | 2014222324 | A | 11/2014 |

* cited by examiner

NOISE-REDUCTION PROCESSING METHOD AND DEVICE, AND EARPHONES

CROSS REFERENCE TO RELATED APPLICATIONS

This application is a U.S. National Stage entry under 35 U.S.C. § 371 based on International Application No. PCT/CN2018/100366, filed on Aug. 14, 2018, which claims priority to Chinese Patent Application No. 201810421059.6, filed on May 4, 2018. These applications are hereby incorporated herein in their entirety by reference.

TECHNICAL FIELD

This Application pertains to the field of sound-signal processing, and in particular to a method and device for noise-reduction processing and an earphone.

BACKGROUND

In the traditional noise protection field, passive noise isolation equipment (for example, ear protectors) is mainly used for noise protection, and the ear protectors are generally large-sized protective ear muffs for isolating noise. The large-sized ear protectors can effectively isolate external noises (especially high-frequency noises), but at the same time also isolate valuable sounds in the external environment, such as alarm sounds having line spectral features and the voice information of a companion nearby, which causes inconvenience to the earphone wearer, and even puts the earphone wearer in a dangerous situation. In addition, although passive noise isolation equipment has good effects in isolating middle and high-frequency noises, it is difficult to isolate low-band noises having large wavelengths and strong penetration capabilities.

At present, many earphones have already had a function of active noise reduction. Active noise reduction refers to the noise reduction by using electronic circuits and sound reinforcement equipment to generate a sound having a phase opposite to that of the noise so as to counteract the original noise. Earphones having the function of active noise reduction are mainly for low-frequency noise reduction. There are advanced earphones provided with an adaptive noise-reduction frequency processing unit. The adaptive noise-reduction frequency processing unit cannot only filter out low-frequency noises, but also middle and high-frequency noises, such as middle and high-frequency noises generated by helicopter propellers. Although this type of earphones can filter out environmental noises fairly well, while filtering out the environmental noise, they also filter out the valuable sound signals in the environmental-sound signal, such as alarm sounds having line spectral features and the voice information of a companion nearby, such that the valuable sound signals of the environmental-sound signal cannot be retained while performing noise reduction on the environmental-sound signal. In addition, other objects, desirable features and characteristics will become apparent from the subsequent summary and detailed description, and the appended claims, taken in conjunction with the accompanying drawings and this background.

SUMMARY

The present disclosure provides a method and device for noise-reduction processing and an earphone, to solve the problem that the existing earphones cannot retain a valuable sound signal in an environmental-sound signal while performing noise reduction on the environmental-sound signal.

According to an aspect of the present disclosure, a method for noise-reduction processing is provided, the method comprising:

collecting an environmental-sound signal by using a feedforward microphone to acquire amplitude information and spectrum information of the environmental-sound signal;

performing feedforward noise-reduction processing on the environmental-sound signal according to the amplitude information of the environmental-sound signal, and extracting a sound signal having a specified frequency in the environmental-sound signal according to the spectrum information of the environmental-sound signal; and outputting the sound signal having the specified frequency together with the signal after being feedforward noise-reduction processed.

According to another aspect of the present disclosure, a device for noise-reduction processing is provided, the device comprising:

a collecting unit for collecting an environmental-sound signal by using a feedforward microphone to acquire amplitude information and spectrum information of the environmental-sound signal;

a feedforward noise-reduction processing unit for performing feedforward noise-reduction processing on the environmental-sound signal according to the amplitude information of the environmental-sound signal acquired by the collecting unit;

an extracting unit for extracting a sound signal having a specified frequency in the environmental-sound signal according to the spectrum information of the environmental-sound signal acquired by the collecting unit; and an outputting unit for outputting the sound signal having the specified frequency extracted by the extracting unit together with the signal after being feedforward noise-reduction processed by the feedforward noise-reduction processing unit.

According to still another aspect of the present disclosure, an earphone is provided. The earphone comprises a feedforward microphone, a feedback microphone and a speaker, the earphone comprises a memory and a processor, the memory stores a computer program executable by the processor, and when the computer program is executed by the processor, the above method steps can be implemented.

The advantageous effects of the present disclosure are as follows. The technical solution of the present disclosure firstly collects an environmental-sound signal by using a feedforward microphone to acquire amplitude information and spectrum information of the environmental-sound signal, then performs feedforward noise-reduction processing according to the amplitude information of the environmental-sound signal, and extracts a sound signal having a specified frequency in the environmental-sound signal according to the spectrum information of the environmental-sound signal, and finally outputs the sound signal having the specified frequency together with the environmental-sound signal after being feedforward noise-reduction processed. As compared with the prior art, the present disclosure can retain the sound signal having the specified frequency in the environmental-sound signal when performing noise-reduction processing, to realize the monitoring of the valuable sound signal in the environmental-sound signal, and avoid that sound signals warning of dangers such as alarms are filtered out and thus the earphone wearer is put in a dangerous state, thereby ensuring the personal safety of the earphone wearer. Moreover, it can prevent the voice of a companion from being completely filtered out, so that the user can still normally communicate with the companion when wearing the earphone, and thus the user experience is improved.

BRIEF DESCRIPTION OF DRAWINGS

The present invention will hereinafter be described in conjunction with the following drawing figures, wherein like numerals denote like elements, and.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The design concept of the present disclosure is as follows. With respect to the problem in the prior art that a valuable sound signal in an environmental-sound signal cannot be retained while a noise signal in an environmental-sound signal is being filtered out, the inventors thought of that, during the noise-reduction processing of the environmental-sound signal, the sound signal having a specified frequency may be extracted according to the spectrum information of the environmental-sound signal, and outputted together with the signal after being noise-reduction processed, thereby retaining the sound signal having the specified frequency in the environmental-sound signal, to realize the monitoring of the valuable sound signal in the environmental-sound signal.

First Embodiment

Figure 1:
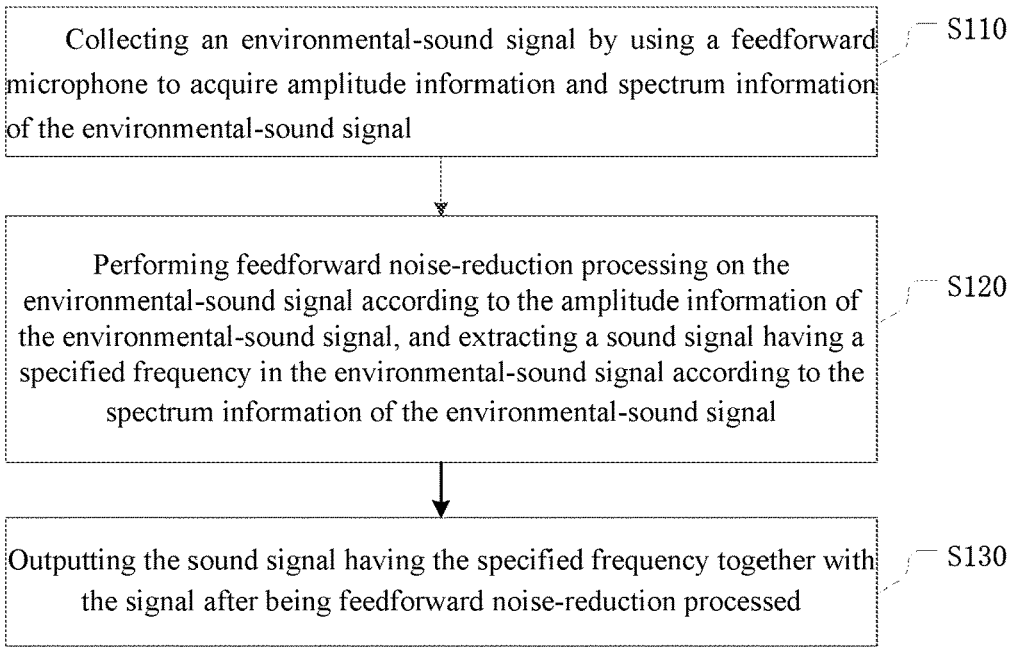
FIG. 1 is a flowchart of a method for noise-reduction processing according to the first embodiment of the present disclosure.

FIG. 1 is a flowchart of a method for noise-reduction processing according to the first embodiment of the present disclosure. As shown in FIG. 1, the method for noise-reduction processing comprises the following steps:

S110: collecting an environmental-sound signal by using a feedforward microphone to acquire amplitude information and spectrum information of the environmental-sound signal.

S120: performing feedforward noise-reduction processing on the environmental-sound signal according to the amplitude information of the environmental-sound signal, and extracting a sound signal having a specified frequency in the environmental-sound signal according to the spectrum information of the environmental-sound signal.

As known by those skilled in the art, the speaker of the earphone plays a time-domain signal, and the time-domain signal may be converted into a frequency-domain signal by Fourier transform to obtain the spectrum information of the signal. Therefore, after collecting the environmental-sound signal by using the feedforward microphone, the environmental-sound signal is subjected to Fourier transform processing to obtain the spectrum information of the environmental-sound signal, so as to extract the sound signal having the specified frequency according to the spectrum information. The specified frequency may be a specific frequency value (i.e., a single frequency signal) or a frequency band with a certain frequency range (i.e., a frequency band signal). In practical applications, the alarm sound having line spectral features and the sound signal of a companion may be retained by setting the specified frequency, so that even if wearing earphones, the user can still monitor these two types of sound signals.

It should be noted that, in the step S120, the "performing feedforward noise-reduction processing on the environmental-sound signal according to the amplitude information of the environmental-sound signal" and the "extracting a sound signal having a specified frequency in the environmental-sound signal according to the spectrum information of the environmental-sound signal" are two independent processing steps without a fixed sequential order, and they may be executed at the same time; alternatively, either of them may be executed first, and the other is executed later.

S130: outputting the sound signal having the specified frequency together with the signal after being feedforward noise-reduction processed.

In this step, inverse Fourier transform is performed on the extracted spectrum information of the specified frequency to obtain the time-domain signal corresponding to the sound signal having the specified frequency, and then the time-domain signal is played by the speaker of the earphone together with the signal after being feedforward noise-reduction processed.

It can be seen that the technical solution of the present disclosure firstly collects an environmental-sound signal by using a feedforward microphone to acquire amplitude information and spectrum information of the environmental-sound signal, then performs feedforward noise-reduction processing according to the amplitude information of the environmental-sound signal, and extracts a sound signal having a specified frequency in the environmental-sound signal according to the spectrum information of the environmental-sound signal, and finally outputs the sound signal having the specified frequency together with the environmental-sound signal after being feedforward noise-reduction processed. As compared with the prior art, the present disclosure can retain the sound signal having the specified frequency in the environmental-sound signal when performing noise-reduction processing, to realize the monitoring of the valuable sound signal in the environmental-sound signal, and avoid that sound signals warning of dangers such as alarms are filtered out and thus the earphone wearer is put in a dangerous state, thereby ensuring the personal safety of the earphone wearer. Moreover, it can prevent the voice of a companion from being completely filtered out, so that the user can still normally communicate with the companion when wearing the earphone, and thus the user experience is improved.

Second Embodiment

Figure 2:
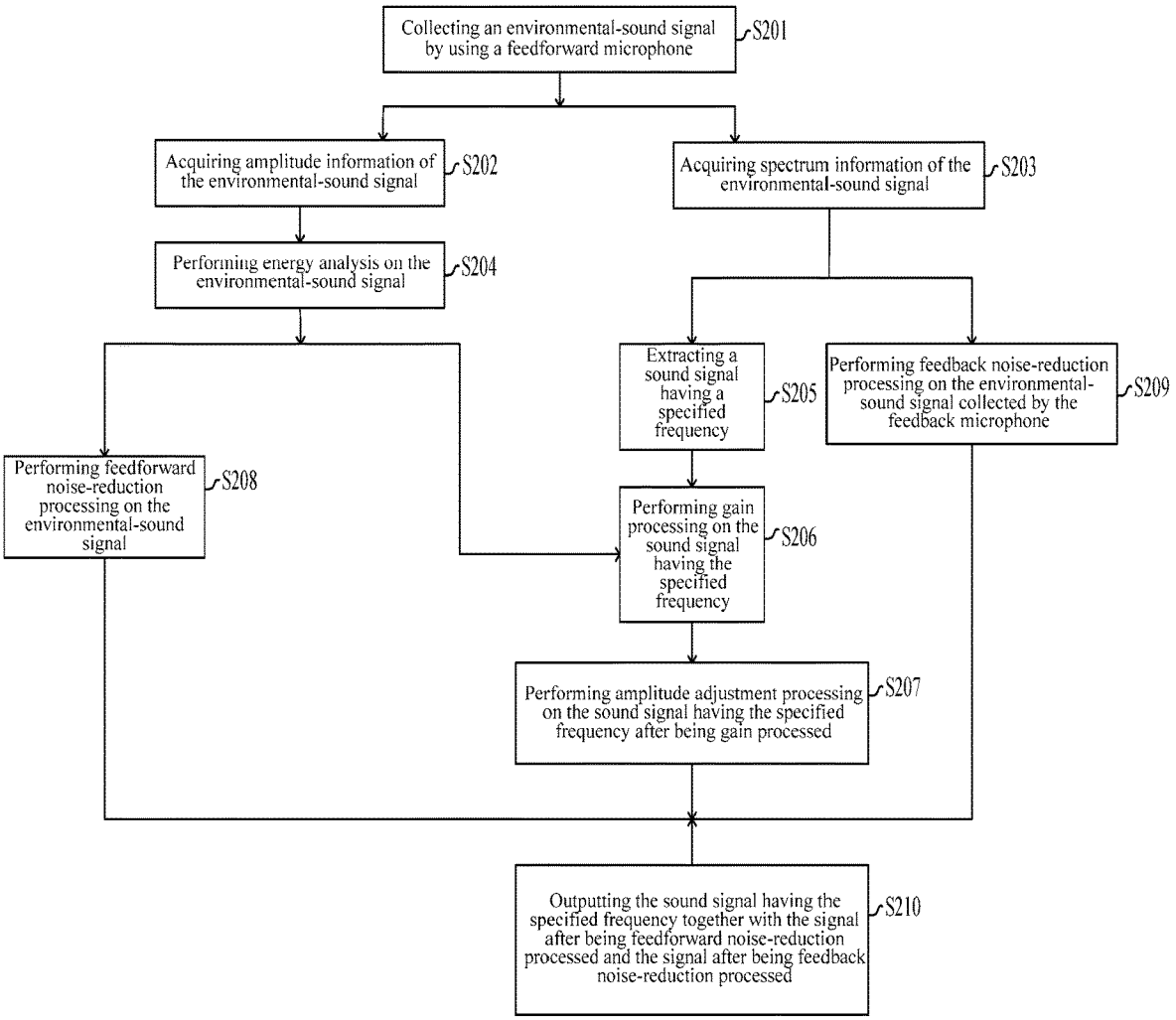
FIG. 2 is a flowchart of another method for noise-reduction processing according to the second embodiment of the present disclosure.

FIG. 2 is a flowchart of another method for noise-reduction processing according to the second embodiment of the present disclosure. As shown in FIG. 2, the method for noise-reduction processing comprises the following steps:

S201: collecting an environmental-sound signal by using a feedforward microphone.

In the step S201, the feedforward microphone collects the environmental-sound signal outside the earphone. After the step S201 is executed, the steps S202 and S203 are executed respectively.

S202: acquiring amplitude information of the environmental-sound signal. After the step S202 is executed, S204 is executed.

S203: acquiring spectrum information of the environmental-sound signal.

In the step S203, the spectrum information of the environmental-sound signal collected by the feedforward microphone is acquired mainly by using Fourier transform technique. After the step S203 is executed, the steps S205 and S209 are executed respectively.

S204: performing energy analysis on the environmental-sound signal. The process of energy analysis is as follows:

The energy information of the environmental-sound signal at each sampling time point is acquired according to the amplitude information of the environmental-sound signal, where the energy information at the current nth sampling time point is P(n), and the energy information corresponding to the (n−1)th sampling time point is P(n−1).

The energy information of the environmental-sound signal at each sampling time point may be acquired by using the following formula 1 and formula 2:

$$\text{power}=\text{power}*(1-\text{alpha})+\Sigma_{n=1}^{N}x(n)*x(n);x(1)=0; \quad \text{(formula 1)}$$

$$P(n)=\text{power} \quad \text{(formula 2)}$$

wherein "power" in formula 1 and formula 2 represents the energy of the environmental-sound signal collected by the feedforward microphone, "alpha" is a numerical variable and represents the weight of the energy of the environmental-sound signal latest collected, and "N" represents the total number of times of sampling the energy of the environmental-sound signal. Here, the range of N may be [1, 1000], and N is a positive integer. "x(n)" represents the amplitude of the environmental-sound signal at the nth sampling time point, and "P(n)" represents the energy of the environmental-sound signal at the nth sampling time point.

After the energy analysis is performed on the environmental-sound signal, the gain processing may be performed on the environmental-sound signal according to the result of the energy analysis, and the step S206 is executed. Alternatively, the feedforward noise-reduction processing may be performed on the environmental-sound signal according to the result of the energy analysis, and the step S208 is executed. In other words, the steps S206 and S208 are respectively executed after the step S204 is executed.

S205: extracting a sound signal having a specified frequency.

It will be illustrated by taking extracting an alarm sound having line spectral features as an example. If the amplitude of a certain frequency point (corresponding to the frequency point of the alarm signal which mainly comprises a single frequency) in the spectrum information of the environmental-sound signal is greater than a first amplitude preset value, for example, if the amplitude of a certain single frequency is higher by 20 than the average value of the amplitudes of 5 or 8 frequency points on its left side, and is higher by 20 than the average value of the amplitudes of 5 or 8 frequency points on its right side, then this frequency signal is regarded as the sound signal of the designated single frequency point.

The method of extracting the sound signal of a companion having a certain frequency range is the same as that of extracting a signal having a single frequency point. For example, if the amplitude of a certain frequency band is higher by 20 than the average value of the amplitudes of 5 to 8 frequency bands on its left side, and is higher by 20 than the average value of the amplitudes of 5 to 8 frequency bands on its right side, then this frequency band signal is regarded as the sound signal of the designated single frequency band.

It should be noted that after the sound signal having the specified frequency is extracted, the sound signal having the specified frequency may be directly outputted without being processed. In other words, the steps S206 and S207 are no longer executed in sequence, and the step S210 is executed directly.

S206: performing gain processing on the sound signal having the specified frequency.

When the gain processing is performed on the sound signal having the specified frequency according to the result of the energy analysis of the step S204, it mainly includes the following four cases:

Case 1: if the energy information P(n) is not greater than a first preset energy threshold, it means that the amplitude of the sound signal having the specified frequency has been maintained within the hearing range of the human ear right now, so the requirements of gain processing can be met by adjusting the current gain A(n) to the initial gain value A(0).

Case 2: if the energy information P(n) is greater than the first preset energy threshold and P(n)/P(n−1) is greater than a first energy-ratio threshold, it means that there is a burst noise outside with a sudden increase in energy, such as the sound of gunfire, and then the current gain value A(n) is adjusted to the initial gain value A(0) by immediately reducing by a first gain value $\text{Delta}(n)_1$, wherein the first gain value $\text{Delta}(n)_1$ is obtained by performing a logarithm operation on the difference between the energy information P(n) and the first preset energy threshold, thereby avoiding damage to the wearer's hearing caused by the sound impact.

Case 3: if the energy information P(n) is greater than the first preset energy threshold, and P(n)/P(n−1) is less than the second energy-ratio threshold, it means that the burst noise has passed the peak value and begins to decay, and then the current gain value A(n) is adjusted to the initial gain value A(0) by immediately reducing by a second gain value $\text{Delta}(n)_2$, wherein the second gain value $\text{Delta}(n)_2$ is obtained by performing a logarithm operation on the difference between the energy information P(n) and the first preset energy threshold. Here, the second gain value $\text{Delta}(n)_2$ is less than the first gain value $\text{Delta}(n)_1$, so that the sound signal having the specified frequency after being gain adjusted is within the hearing range of the human ear.

Case 4: if the energy information P(n) is greater than the first preset energy threshold, and P(n)/P(n−1) is between the first energy-ratio threshold and the second energy-ratio threshold (including the cases where it is equal to the first energy-ratio threshold and where it is equal to the second energy-ratio threshold), it means that the noise increases suddenly and then stabilizes, and then the current gain value A(n) is adjusted to be between the initial gain value A(0) and the gain obtained by subtracting a third gain value $\text{Delta}(n)_3$ from the initial gain value A(0) (i.e., $A(0)-\text{Delta}(n)_3$).

It should be noted that the "first gain value $\text{Delta}(n)_1$" in the Case 2, the "second gain value $\text{Delta}(n)_2$" in the Case 3, and the "third gain value $\text{Delta}(n)_3$" in the Case 4 are calculated in the same way, and are all obtained by performing a logarithm operation on the difference between the energy information P(n) and the first preset energy threshold. Particularly, the first gain value $\text{Delta}(n)_1$, the second gain value $Delta(n)_2$ or the third gain value $Delta(n)_3$ may be calculated according to the following formula:

$$Delta(n)=20*\log(P_{(n)}-p_1) \quad \text{(formula 3)}$$

wherein in the formula 3 Delta(n) is a gain value with the unit of decibel (dB), P(n) is the energy information at the current nth sampling time point, and $p_1$ is the first preset energy threshold. It should be noted that P(n) and $p_1$ are both a quantized time domain value, and a gain value is obtained by performing a logarithm operation on the difference between P(n) and $p_1$ by using the formula 3.

In the process of adjusting the current gain value A(n) to be between the initial gain value A(0) and the gain obtained by subtracting a third gain value $Delta(n)_3$ from the initial gain value A(0) (i.e., $A(0)-Delta(n)_3$), firstly, starting from the current sampling time point, the current gain value A(n) is adjusted to attenuate from the initial gain value A(0) at an attenuation speed; in the attenuation process, corresponding to an (n+m)th sampling time point of the environmental-sound signal, energy information is P(n+m) and gain value is A(n+m) if energy information P(n+m) is less than the first preset energy threshold, making the gain value A(n+m) restore to the initial gain value A(0) at a growth speed; and while the gain value A(n+m) is restoring to the initial gain value A(0) at the growth speed, if the P(n+m) is greater than the first preset energy threshold, the gain value A(n+m) is attenuated again at the attenuation speed. The attenuation speed is a ratio of a value obtained by performing logarithm operation on a difference between the P(n+m) and the first preset energy threshold to a first preset time period t1; i.e., $V_{attenuation}$=Delta(n+m)/t1. The growth speed is a ratio of a value obtained by performing logarithm operation on a difference between the P(n+m) and the first preset energy threshold to a second preset time period t2; i.e., $V_{growth}$=Delta(n+m)/t2. The value of the attenuation speed is adjusted by adjusting the length of the first preset time period t1, and the value of the growth speed is adjusted by adjusting the length of the second preset time period t2, so that the sound signal having the specified frequency is maintained within the hearing range of the human ear.

It should be noted that the first preset time period and the second preset time period are obtained through a lot of pre-training, and of course, the first preset time period and the second preset time period may also be set by the user.

In order to make the processing of the above Case 4 (i.e., the energy information P(n) is greater than the first preset energy threshold, and P(n)/P(n−1) is between the first energy-ratio threshold and the second energy-ratio threshold) clear, a specific example will be explained below.

Step 1: the gain value obtained by performing a logarithm operation on the difference between the energy information P(n) and the first preset energy threshold is recorded as Delta(n), and the unit of the gain value is decibel (dB). Starting from a current sampling time point, to the end of the mth sampling time point, the gain A(n) at each current nth sampling time point is attenuated from the initial gain value A(0) at the attenuation speed of Delta(n)/m dB, wherein m indicates that the first preset time period t1 is divided into m equal time periods. Here, the value range of m may be [1, 1000], and m is a positive integer.

Step 2: when the m sampling time periods expire (i.e., after the n+mth time point), the gain corresponding to the first preset time period t1 is A(n+m), and the gain A(n+m) is smaller (from the initial gain value A(0)) by Delta(n); i.e., Delta(n)=Delta(n)/m dB*m.

Step 3: if when the m sampling time periods expire (i.e., after the n+mth time point), the energy information P(n+m) of the environmental-sound signal is less than the first preset energy threshold, then the gain value A(n+m) is restored to the initial gain value A(0) at a growth speed. For example, at the Qth sampling time point, the gain A(n+m) is restored to the initial gain value A(0).

Here, it is further assumed that the time period from the nth sampling time point to the mth sampling time point is t1, and the time period from the mth sampling time point to the Qth sampling time point is t2; that is, within the time period t1, the current gain A(n) is attenuated from the initial gain value A(0) at the attenuation speed of Delta(n)/m dB, and within the time period t2, the gain value A(n+m) is restored to the initial gain value A(0) at the growth speed. By adjusting the lengths of t1 and t2, the attenuation and growth speeds can be adjusted, thereby controlling the sound signal having the specified frequency to be within the hearing range of the human ear.

Step 4: in the process of making the gain A(n+m) restore to the initial gain value A(0) at the growth speed in the Step 3, if the energy information P(n+m) is greater than the first preset energy threshold, the Step 1 is executed, and starting from the current sampling time point the gain A(n+m) is attenuated again at the attenuation speed of Delta(n)/m dB. In this embodiment, the value ranges of n and m may be [1, 1000], and n and m are positive integers.

In practical applications, the first preset energy threshold, the first energy-ratio threshold, and the second energy-ratio threshold may be set by the user, and the user may change those thresholds according to the application scenarios, thereby making the technical solution applicable to various application scenarios and achieving a more human-friendly design.

It can be seen that the technical solution of the present disclosure performs different gain processing on the sound signal having the specified frequency by analyzing the energy of the environmental-sound signal, thereby ensuring that the sound signal having the specified frequency transmitted to the human ear is within the hearing range of the human ear, so as to avoid the impact of external burst noise on the wearer of the earphone and improve the user experience.

At this point, after performing gain processing on the sound signal having the specified frequency, the sound signal having the specified frequency after being gain processed may be directly outputted. In other words, after the step S206 is executed, the step S207 is no longer executed, and the step S210 is directly executed.

S207: performing amplitude adjustment processing on the sound signal having the specified frequency after being gain processed. After the step S207 is executed, the step S210 is executed.

In this step S207, the amplitude value of the sound signal having the specified frequency after being gain processed is adjusted to a preset amplitude range. Specifically, it is determined whether the amplitude value of the sound signal having the specified frequency after being gain processed is within the preset amplitude range, and if not, the amplitude value of the sound signal is adjusted to the preset amplitude range. For example, if the amplitude value of the extracted sound signal having the specified frequency is 100 and the preset amplitude range is (50, 70), the amplitude value of the sound signal is adjusted to the preset amplitude range. The preset amplitude range is set according to the normal hearing range of the human ear, which prevents the extracted sound signal having the specified frequency from being too loud and causing damage to the human ear, and also prevents the extracted sound signal having the specified frequency from being too small and neglected by the human ear. Thus, the technical solution of the present disclosure can further improve the user experience by performing amplitude adjustment processing on the amplitude value of the sound signal having the specified frequency after being gain processed.

S208: performing feedforward noise-reduction processing on the environmental-sound signal. After the step S208 is executed, the step S210 is executed.

In the step S208, different feedforward noise-reduction processing is performed on the environmental sound collected by the feedforward microphone according to the result of the energy analysis of the step S204. Specifically, the feedforward noise-reduction processing mainly includes the following three cases:

Case 1: if P(n) is less than the second preset energy threshold, it means that there is almost no noise information contained in the current environmental-sound signal, and no feedforward noise-reduction processing is needed, and then the current feedforward noise-reduction coefficient is controlled to be set to 0.

Case 2: if P(n) is greater than the third preset energy threshold, it means that the current environmental-sound signal contains much noise information, and then the current feedforward noise-reduction coefficient is controlled to remain unchanged. That is to say, in this case, good feedforward noise-reduction processing can be performed on the environmental-sound signal by using the current feedforward noise-reduction coefficient in the feedforward noise-reduction module, and there is no need to change the feedforward noise-reduction coefficient.

Case 3: if P(n) is between the second preset energy threshold and the third preset energy threshold, it means that the current environmental-sound signal contains little noise information, and then the current feedforward noise-reduction coefficient is controlled to reduce by one preset value of the noise-reduction coefficient. The second preset energy threshold is less than the third preset energy threshold. Here, the second preset energy threshold and the third preset energy threshold may be set by the user, and the user may change those thresholds according to the application scenarios, so that the technical solution is applicable to various application scenarios, and then different feedforward noise-reduction processing are performed with respect to different application scenarios, thereby achieving a more human-friendly design.

It can be seen that the technical solution of the present disclosure can perform different feedforward noise-reduction processing with respect to different environmental-sound signals by performing energy analysis of the environmental-sound signals, which does not only ensure the accuracy of the feedforward noise-reduction processing, but also better filters out the noise in the environmental-sound signal outside the earphone, and can also achieve the object of reducing system power consumption.

It should be noted that the preset value of the noise-reduction coefficient and the current noise-reduction coefficient in this embodiment may be set according to the needs of actual applications, and the value ranges of the preset value of the noise-reduction coefficient and the current noise-reduction coefficient are not limited in the present disclosure. In addition, in practical applications, the second preset energy threshold and the third preset energy threshold may be set by the user, and the user may change those thresholds according to the application scenarios, thereby making the technical solution applicable to various application scenarios and achieving a more human-friendly design.

S209: performing feedback noise-reduction processing on the environmental-sound signal collected by the feedback microphone. After the step S209 is executed, the step S210 is executed.

The feedback microphone collects the environmental sound signal inside the earphone. In this step S209, the feedback noise-reduction processing performed on the environmental-sound signal collected by the feedback microphone is implemented mainly by the following three steps:

Step 1: the current scene mode is determined at a preset time interval according to the spectrum information of the environmental-sound signal acquired in the step S203. In this step, a vector based on spectral features is pre-stored for each scene mode. For example, the spectral feature of scene mode 1 is recorded as vector FM1, the spectral feature of scene mode 2 is recorded as vector FM2, the spectral feature of scene mode 3 is recorded as vector FM3, and they are obtained by intercepting the total spectrum information or a piece of spectrum information in the total spectrum information. For example, the sampling frequency of the feedforward microphone is 4 kHz. In practical applications, an appropriate frequency band may be intercepted in the 4 kHz spectrum information according to the computing power of the central processing chip and recorded as a vector FF. According to the formula 3, the correlation operations are sequentially performed on vector FF with FM1, FM2, FM3 . . . FM(i) to obtain a set of correlation coefficients r1, r2, r3 . . . ri, and then the scene mode corresponding to the maximum correlation coefficient is the current scene mode. If the correlation coefficient r1 is the maximum, the current scene mode is scene mode 1.

$$r = \frac{\sum_{i=1}^{F} ((FF(i) \quad \overline{FF})(FM(i) \quad \overline{FM}))}{\sqrt{\sum_{i=1}^{F} (FF(i) \quad \overline{FF})^2} \sqrt{\sum_{i=1}^{F} (FM(i) \quad \overline{FM})^2}} \qquad \text{(formula 4)}$$

In formula 4, r represents the correlation coefficient, $\overline{FF}$ represents the average value of the vector FF, F is the length of the vector FF, $\overline{FM}$ is the average value of the vectors based on spectral features corresponding to each scene mode, and FM(i) is the ith value in the vectors based on spectral features corresponding to each scene mode. If the vector FM1 is taken as an example, FM(i) represents the ith value in the vector FM1(*i*).

Each scene mode has unique spectral features. By performing correlation analysis on the spectrum, the current scene mode is determined. In the process of the scene-mode analysis, each scene-mode analysis will cause a certain degree of power loss, and especially when the time interval between two adjacent scene-mode analyses is smaller, the requirements on the computing power are higher and the power consumption is greater. Therefore, the scene-mode analysis cannot be performed in real time, and a preset time interval needs to be set reasonably, for example 5 s, to reduce the system power consumption. In practical applications, the preset time interval may be set according to the system computing power and the actual needs.

Step 2: the feedback noise-reduction coefficient corresponding to the current scene mode determined in the Step 1 is acquired.

After the current scene mode is determined by the method in the Step 1 stated above, a table of the preset scene modes and the feedback noise-reduction coefficients is looked up according to the determined current scene mode, as shown in Table 1.

TABLE 1

Table of scene modes and feedback noise-reduction coefficients

| Scene Mode | Feedback Noise-Reduction Coefficient |
|---|---|
| Scene Mode 1 (FM1) | Fb1 |
| Scene Mode 2 (FM2) | Fb2 |
| Scene Mode 3 (FM3) | Fb3 |

For example, for the current scene mode 2, it can be known by looking up Table 1 that the feedback noise-reduction coefficient corresponding to the scene mode 2 is Fb2.

Step 3: the feedback noise-reduction processing is performed on the environmental-sound signal collected by the feedback microphone according to the feedback noise-reduction coefficient, and the signal after being feedback noise-reduction processed is outputted.

For example, the feedback noise-reduction processing is performed on the environmental-sound signal inside the earphone collected by the feedback microphone by using the feedback noise-reduction coefficient Fb2 determined in the Step 2, to filter out the noise in the environmental-sound signal inside the earphone collected by the feedback microphone.

S210: outputting the sound signal having the specified frequency together with the signal after being feedforward noise-reduction processed and the signal after being feedback noise-reduction processed.

It should be noted that after the execution of the steps S208 and S207 is completed, the sound signal outputted comprises two parts:

(1) the sound signal obtained after performing feedforward noise-reduction processing on the environmental-sound signal outside the earphone collected by the feedforward microphone; and (2) the sound signal having the specified frequency extracted from the environmental-sound signal outside the earphone collected by the feedforward microphone.

After the step S209 is executed, the sound signal outputted is added by another part:

(3) the sound signal obtained after performing feedback noise-reduction processing on the environmental-sound signal inside the earphone collected by the feedback microphone.

It can be seen that the present disclosure retains the sound signal having the specified frequency in the environmental-sound signal while reducing the noise of the environmental-sound signal, and can realize the monitoring of the valuable sound signal in the environmental-sound signal.

Third Embodiment

Figure 3:
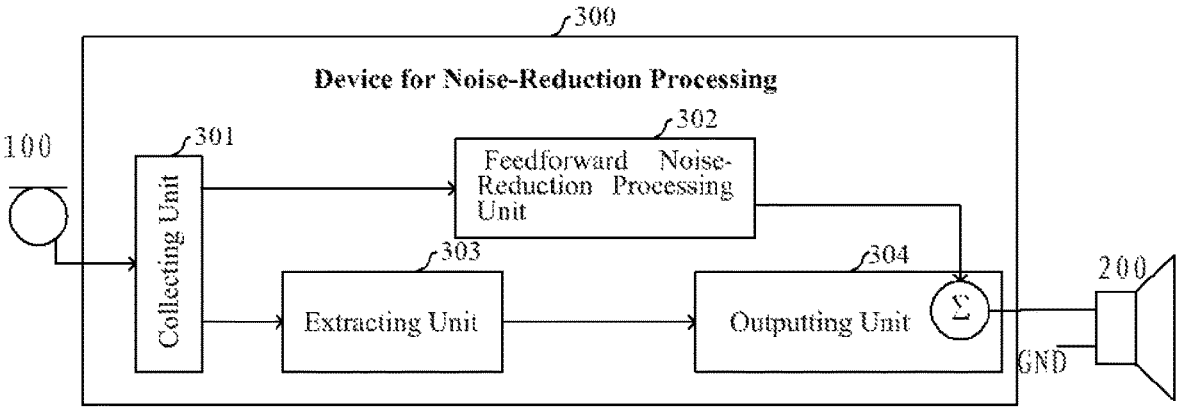
FIG. 3 is a schematic diagram of a functional structure of a device for noise-reduction processing according to the third embodiment of the present disclosure.

FIG. 3 is a schematic diagram of a functional structure of a device for noise-reduction processing according to the third embodiment of the present disclosure. As shown in FIG. 3, the device for noise-reduction processing 300 comprises:

a collecting unit 301 for collecting an environmental-sound signal by using a feedforward microphone 100 to acquire amplitude information and spectrum information of the environmental-sound signal;

a feedforward noise-reduction processing unit 302 for performing feedforward noise-reduction processing on the environmental-sound signal according to the amplitude information of the environmental-sound signal acquired by the collecting unit 301;

an extracting unit 303 for extracting a sound signal having a specified frequency in the environmental-sound signal according to the spectrum information of the environmental-sound signal acquired by the collecting unit 301; and an outputting unit 304 for outputting the sound signal having the specified frequency extracted by the extracting unit 303 to the speaker 200 together with the signal after being feedforward noise-reduction processed by the feedforward noise-reduction processing unit 302.

According to the technical solution of the present disclosure, the collecting unit 301 firstly uses the feedforward microphone 100 to collect an environmental-sound signal to acquire amplitude information and spectrum information of the environmental-sound signal, then the feedforward noise-reduction processing unit 302 performs feedforward noise-reduction processing according to the amplitude information of the environmental-sound signal, and the extracting unit 303 extracts a sound signal having a specified frequency in the environmental-sound signal according to the spectrum information of the environmental-sound signal, and finally the outputting unit 304 outputs the sound signal having the specified frequency extracted by the extracting unit 303 together with the signal after being feedforward noise-reduction processed by the feedforward noise-reduction processing unit 302.

As compared with the prior art, the present disclosure can retain the sound signal having the specified frequency in the environmental-sound signal when performing noise-reduction processing, to realize the monitoring of the valuable sound signal in the environmental-sound signal, and avoid that sound signals warning of dangers such as alarms are filtered out and thus the earphone wearer is put in a dangerous state, thereby ensuring the personal safety of the earphone wearer. Moreover, it can prevent the voice of a companion from being completely filtered out, so that the user can still normally communicate with the companion when wearing the earphone, and thus the user experience is improved.

It should be noted that the working process of the sound signal outputting device 300 shown in FIG. 3 is the same or partially the same as the implementation steps of the embodiments of the method for noise-reduction processing shown in FIG. 1, and the same contents will not be repeated.

Fourth Embodiment

Figure 4:
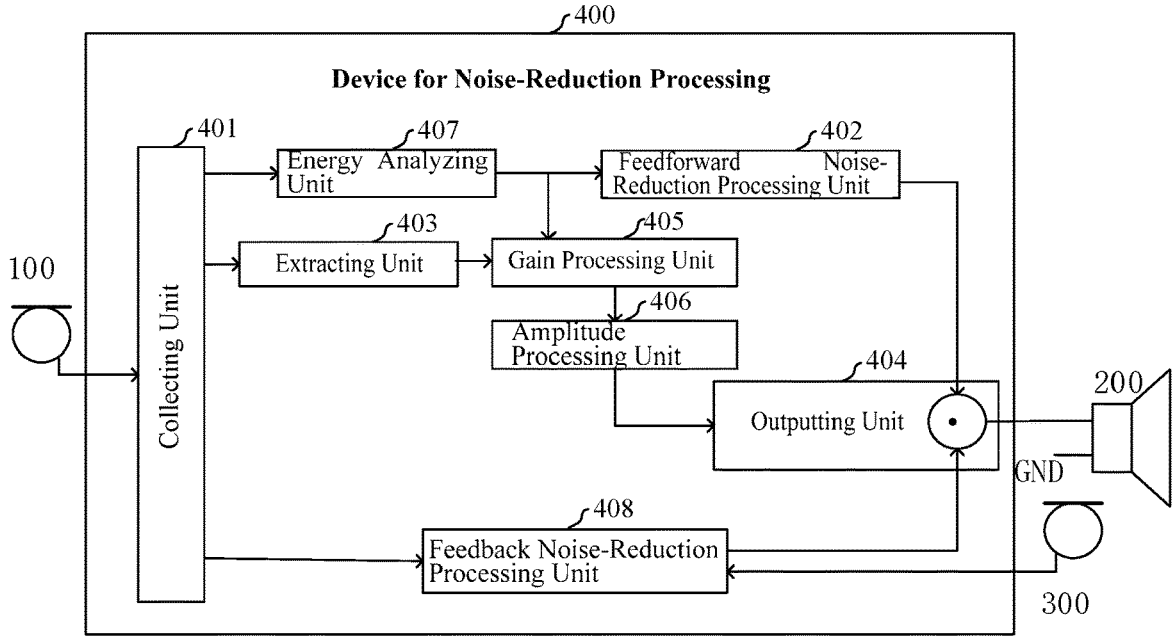
FIG. 4 is a schematic diagram of a functional structure of another device for noise-reduction processing according to the fourth embodiment of the present disclosure.

FIG. 4 is a schematic diagram of a functional structure of a device for noise-reduction processing according to the fourth embodiment of the present disclosure. As shown in FIG. 4, the device for noise-reduction processing 400 comprises:

a collecting unit 401 for collecting an environmental-sound signal by using a feedforward microphone 100 to acquire amplitude information and spectrum information of the environmental-sound signal;

a feedforward noise-reduction processing unit 402 for performing feedforward noise-reduction processing on the environmental-sound signal according to the amplitude information of the environmental-sound signal acquired by the collecting unit 401;

an extracting unit 403 for extracting a sound signal having a specified frequency in the environmental-sound signal according to the spectrum information of the environmental-sound signal acquired by the collecting unit 401; and an outputting unit 404 for outputting the sound signal having the specified frequency extracted by the extracting unit 403 together with the signal after being feedforward noise-reduction processed by the feedforward noise-reduction processing unit 402.

In an embodiment of the present disclosure, the device for noise-reduction processing 400 further comprises:

an energy analyzing unit 407 for acquiring energy information of the environmental-sound signal at each sampling time point according to the amplitude information of the environmental-sound signal acquired by the collecting unit 401, wherein energy information of the environmental-sound signal corresponding to a current nth sampling time point is P(n), and energy information of the environmental-sound signal corresponding to an (n−1)th sampling time point is P(n−1).

In an embodiment of the present disclosure, the device for noise-reduction processing 400 further comprises a gain processing unit 405 and an amplitude processing unit 406.

The gain processing unit 405 is configured to perform gain processing on the sound signal having the specified frequency extracted by the extracting unit 403 according to the amplitude information of the environmental-sound signal acquired by the collecting unit 401; and The amplitude processing unit 406 is configured to adjust the amplitude value of the sound signal having the specified frequency after being gain processed by the gain processing unit 405 to a preset amplitude range, and sending it to the outputting unit 404.

In an embodiment of the present disclosure, the gain processing unit 405 is specifically configured to:

if the P(n) is not greater than a first preset energy threshold, adjust a current gain value A(n) to an initial gain value A(0);

if the P(n) is greater than the first preset energy threshold, and the P(n)/P(n−1) is greater than a first energy-ratio threshold, or, the P(n)/P(n−1) is less than a second energy-ratio threshold, adjust the current gain value A(n) to be less than the initial gain value A(0) by one gain value; and if the P(n) is greater than the first preset energy threshold, and the P(n)/P(n−1) is between the first energy-ratio threshold and the second energy-ratio threshold, adjust the current gain value A(n) to be between the initial gain value A(0) and a gain obtained by subtracting the gain value from the initial gain value A(0);

wherein the gain value is obtained by performing a logarithm operation on a difference between the P(n) and the first preset energy threshold.

In an embodiment of the present disclosure, the gain processing unit 405 is further specifically configured to:

when adjusting the current gain value A(n) to be between the initial gain value A(0) and a gain obtained by subtracting the gain value from the initial gain value A(0), starting from a current sampling time point, adjust the current gain value A(n) to attenuate from the initial gain value A(0) at an attenuation speed;

in the attenuation process, if energy information P(n+m) of the environmental-sound signal corresponding to an (n+m)th sampling time point is less than the first preset energy threshold, make the current gain value A(n+m) restore to the initial gain value A(0) at a growth speed; and while the current gain value A(n+m) is restoring to the initial gain value A(0) at the growth speed, if the P(n+m) is greater than the first preset energy threshold, making the current gain value A(n+m) attenuate again at the attenuation speed;

wherein the attenuation speed is a ratio of a value obtained by performing logarithm operation on a difference between the P(n+m) and the first preset energy threshold to a first preset time period;

the growth speed is a ratio of a value obtained by performing logarithm operation on a difference between the P(n+m) and the first preset energy threshold to a second preset time period;

a value of the attenuation speed is adjusted by adjusting a length of the first preset time period; and a value of the growth speed is adjusted by adjusting a length of the second preset time period.

In an embodiment of the present disclosure, the feedforward noise-reduction processing unit 402 is specifically configured to:

if the P(n) is less than a second preset energy threshold, control the current feedforward noise-reduction coefficient to be set to 0;

if the P(n) is greater than a third preset energy threshold, control the current feedforward noise-reduction coefficient to remain unchanged; and if the P(n) is between the second preset energy threshold and the third preset energy threshold, control the current feedforward noise-reduction coefficient to be reduced by one noise-reduction-coefficient preset value;

wherein the second preset energy threshold is less than the third preset energy threshold.

In an embodiment of the present disclosure, the device for noise-reduction processing 400 further comprises:

a feedback noise-reduction processing unit 408 for determining a current scene mode at a preset time interval according to the spectrum information of the environmental-sound signal acquired by the collecting unit, acquiring a feedback noise-reduction coefficient corresponding to the current scene mode, performing feedback noise-reduction processing on an environmental-sound signal collected by a feedback microphone 300 according to the feedback noise-reduction coefficient, and outputting a signal after being feedback noise-reduction processed.

It should be noted that the working process of the sound signal outputting device 400 shown in FIG. 4 is the same or partially the same as the implementation steps of the embodiments of the method for noise-reduction processing shown in FIG. 2, and the same contents will not be repeated.

Fifth Embodiment

Figure 5:
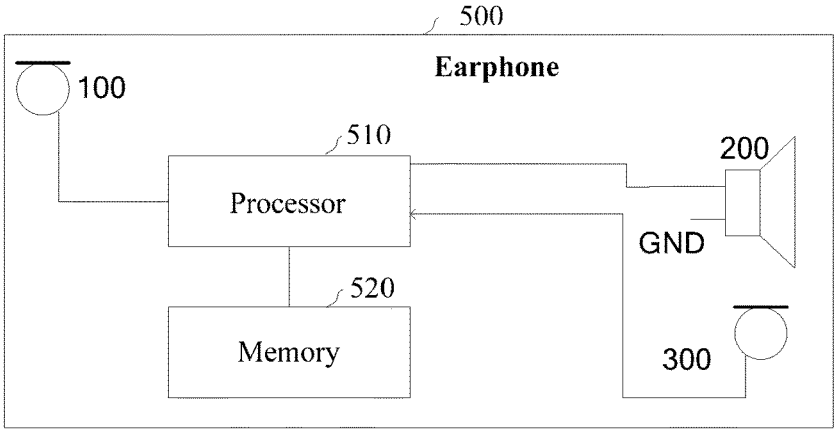
FIG. 5 is a schematic diagram of a functional structure of an earphone according to the fifth embodiment of the present disclosure.

FIG. 5 is a schematic diagram of a functional structure of an earphone according to the fifth embodiment of the present disclosure. As shown in FIG. 5, the earphone 500 comprises a feedforward microphone 100, a feedback microphone 300 and a speaker 200. The earphone 500 comprises a processor 510 and a memory 520, and the memory 520 stores a computer program that can be executed by the processor 510. When the computer program is executed by the processor 510, the method steps shown in FIG. 1 or FIG. 2 can be implemented. This earphone can retain the sound signal having the specified frequency in the environmental-sound signal during active noise-reduction processing, to realize the monitoring of the valuable sound signal in the environmental-sound signal, and avoid that sound signals warning of dangers such as alarms are filtered out and thus the earphone wearer is put in a dangerous state, thereby ensuring the personal safety of the earphone wearer. Moreover, it can prevent the voice of a companion from being completely filtered out, so that the user can still normally communicate with the companion when wearing the earphone, and thus the user experience is improved.

In sum, the technical solution of the present disclosure collects an environmental-sound signal by using a feedforward microphone, and extracts a sound signal having a specified frequency from the environmental-sound signal according to the spectrum information of the environmental-sound signal, and can output the sound signal having the specified frequency together with the environmental-sound signal after being feedforward noise-reduction processed. As compared with the prior art, in which the monitoring of a signal having a specified frequency cannot be achieved while a noise signal in an environmental-sound signal is being filtered out, the present disclosure can retain the sound signal having the specified frequency in the environmental-sound signal, to realize the monitoring of the valuable sound signal in the environmental-sound signal, and avoid that sound signals warning of dangers such as alarms are filtered out and thus the earphone wearer is put in a dangerous state, thereby ensuring the personal safety of the earphone wearer. Moreover, it can prevent the voice of a companion from being completely filtered out, so that the user can still normally communicate with the companion when wearing the earphone, and thus the user experience is improved.

The above merely describes particular embodiments of the present disclosure. By the teaching of the present disclosure, a person skilled in the art can make other modifications or variations based on the above embodiments. A person skilled in the art should appreciate that the detailed description above is only for the purpose of better explaining the present disclosure, and the protection scope of the present disclosure should be subject to the protection scope of the claims.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for noise-reduction processing, comprising:

collecting an environmental-sound signal by using a feedforward microphone to acquire amplitude information and spectrum information of the environmental-sound signal;

performing feedforward noise-reduction processing on the environmental-sound signal according to the amplitude information of the environmental-sound signal, and extracting a sound signal having a specified frequency in the environmental-sound signal according to the spectrum information of the environmental-sound signal;

outputting the sound signal having the specified frequency together with a signal after being feedforward noise-reduction processed; and wherein after acquiring the amplitude information of the environmental-sound signal, the method further comprises:

acquiring energy information of the environmental-sound signal at each sampling time point according to the amplitude information of the environmental-sound signal, wherein energy information of the environmental-sound signal corresponding to a current nth sampling time point is P(n), and energy information of the environmental-sound signal corresponding to an (n−1) th sampling time point is P(n−1).

2. The method according to claim 1, wherein after extracting a sound signal having a specified frequency in the environmental-sound signal, and before outputting the sound signal having the specified frequency together with the signal after being feedforward noise-reduction processed, the method further comprises:

performing gain processing on the sound signal having the specified frequency according to the amplitude information of the environmental-sound signal; and adjusting an amplitude value of the sound signal having the specified frequency after being gain processed to a preset amplitude range.

3. The method according to claim 2, wherein the step of performing gain processing on the sound signal having the specified frequency comprises:

if the P(n) is not greater than a first preset energy threshold, adjusting a current gain value A(n) to an initial gain value A(0);

if the P(n) is greater than the first preset energy threshold, and the P(n)/P(n−1) is greater than a first energy-ratio threshold, or, the P(n)/P(n−1) is less than a second energy-ratio threshold, adjusting the current gain value A(n) to be less than the initial gain value A(0) by one gain value; and if the P(n) is greater than the first preset energy threshold, and the P(n)/P(n−1) is between the first energy-ratio threshold and the second energy-ratio threshold, adjusting the current gain value A(n) to be between the initial gain value A(0) and a gain obtained by subtracting the gain value from the initial gain value A(0);

wherein the gain value is obtained by performing a logarithm operation on a difference between the P(n) and the first preset energy threshold.

4. The method according to claim 3, wherein the step of adjusting the current gain value A(n) to be between the initial gain value A(0) and a gain obtained by subtracting the gain value from the initial gain value A(0) comprises:

starting from a current sampling time point, adjusting the current gain value A(n) to attenuate from the initial gain value A(0) at an attenuation speed;

in the attenuation process, corresponding to an (n+m)th sampling time point of the environmental-sound signal, energy information is P(n+m) and gain value is A(n+m), if the energy information P(n+m) is less than the first preset energy threshold, making the gain value A(n+m) restore to the initial gain value A(0) at a growth speed; and while the gain value A(n+m) is restoring to the initial gain value A(0) at the growth speed, if the P(n+m) is greater than the first preset energy threshold, making the gain value A(n+m) attenuate again at the attenuation speed;

wherein the attenuation speed is a ratio of a value obtained by performing logarithm operation on a difference between the P(n+m) and the first preset energy threshold to a first preset time period;

the growth speed is a ratio of a value obtained by performing logarithm operation on a difference between the P(n+m) and the first preset energy threshold to a second preset time period;

a value of the attenuation speed is adjusted by adjusting a length of the first preset time period; and a value of the growth speed is adjusted by adjusting a length of the second preset time period.

5. The method according to claim 2, wherein the step of performing feedforward noise-reduction processing on the environmental-sound signal comprises: if the P(n) is less than a second preset energy threshold, controlling a current feedforward noise-reduction coefficient to be set to 0; if the P(n) is greater than a third preset energy threshold, controlling a current feedforward noise-reduction coefficient to remain unchanged; and if the P(n) is between the second preset energy threshold and the third preset energy threshold, controlling a current feedforward noise-reduction coefficient to be reduced by one noise-reduction-coefficient preset value; wherein the second preset energy threshold is less than the third preset energy threshold.

6. The method according to claim 1, further comprising:

determining a current scene mode at a preset time interval according to the spectrum information of the environmental-sound signal;

acquiring a feedback noise-reduction coefficient corresponding to the current scene mode; and performing feedback noise-reduction processing on an environmental-sound signal collected by a feedback microphone according to the feedback noise-reduction coefficient, and outputting a signal after being feedback noise-reduction processed.

7. An earphone, comprising a feedforward microphone, a feedback microphone and a speaker, wherein the earphone comprises a memory and a processor, the memory stores a computer program executable by the processor, and when the computer program is executed by the processor, a method for noise-reduction processing is implemented, and the method comprising:

collecting an environmental-sound signal by using the feedforward microphone to acquire amplitude information and spectrum information of the environmental-sound signal;

performing feedforward noise-reduction processing on the environmental-sound signal according to the amplitude information of the environmental-sound signal, and extracting a sound signal having a specified frequency in the environmental-sound signal according to the spectrum information of the environmental-sound signal;

outputting the sound signal having the specified frequency together with a signal after being feedforward noise-reduction processed; and wherein after acquiring the amplitude information of the environmental-sound signal, the method further comprises: acquiring energy information of the environmental-sound signal at each sampling time point according to the amplitude information of the environmental-sound signal, wherein energy information of the environmental-sound signal corresponding to a current $n^{th}$ sampling time point is P(n), and energy information of the environmental-sound signal corresponding to an $(n-1)^{th}$ sampling time point is P(n−1).

8. The earphone according to claim 7, wherein after extracting a sound signal having a specified frequency in the environmental-sound signal, and before outputting the sound signal having the specified frequency together with the signal after being feedforward noise-reduction processed, the method further comprises:

performing gain processing on the sound signal having the specified frequency according to the amplitude information of the environmental-sound signal; and adjusting an amplitude value of the sound signal having the specified frequency after being gain processed to a preset amplitude range.

9. The earphone according to claim 8, wherein the step of performing gain processing on the sound signal having the specified frequency comprises:

if the P(n) is not greater than a first preset energy threshold, adjusting a current gain value A(n) to an initial gain value A(0);

if the P(n) is greater than the first preset energy threshold, and the P(n)/P(n−1) is greater than a first energy-ratio threshold, or, the P(n)/P(n−1) is less than a second energy-ratio threshold, adjusting the current gain value A(n) to be less than the initial gain value A(0) by one gain value; and if the P(n) is greater than the first preset energy threshold, and the P(n)/P(n−1) is between the first energy-ratio threshold and the second energy-ratio threshold, adjusting the current gain value A(n) to be between the initial gain value A(0) and a gain obtained by subtracting the gain value from the initial gain value A(0);

wherein the gain value is obtained by performing a logarithm operation on a difference between the P(n) and the first preset energy threshold.

10. The earphone according to claim 9, wherein the step of adjusting the current gain value A(n) to be between the initial gain value A(0) and a gain obtained by subtracting the gain value from the initial gain value A(0) comprises:

starting from a current sampling time point, adjusting the current gain value A(n) to attenuate from the initial gain value A(0) at an attenuation speed;

in the attenuation process, corresponding to an (n+m)th sampling time point of the environmental-sound signal, energy information is P(n+m) and gain value is A(n+m), if the energy information P(n+m) is less than the first preset energy threshold, making the gain value A(n+m) restore to the initial gain value A(0) at a growth speed; and while the gain value A(n+m) is restoring to the initial gain value A(0) at the growth speed, if the P(n+m) is greater than the first preset energy threshold, making the gain value A(n+m) attenuate again at the attenuation speed;

wherein the attenuation speed is a ratio of a value obtained by performing logarithm operation on a difference between the P(n+m) and the first preset energy threshold to a first preset time period;

the growth speed is a ratio of a value obtained by performing logarithm operation on a difference between the P(n+m) and the first preset energy threshold to a second preset time period;

a value of the attenuation speed is adjusted by adjusting a length of the first preset time period; and a value of the growth speed is adjusted by adjusting a length of the second preset time period.

11. The earphone according to claim 7, wherein after acquiring the amplitude information of the environmental-sound signal, the method further comprises:

acquiring energy information of the environmental-sound signal at each sampling time point according to the amplitude information of the environmental-sound signal, wherein energy information of the environmental-sound signal corresponding to a current nth sampling time point is P(n), and energy information of the environmental-sound signal corresponding to an (n−1) th sampling time point is P(n−1);

wherein the step of performing feedforward noise-reduction processing on the environmental-sound signal comprises:

if the P(n) is less than a second preset energy threshold, controlling a current feedforward noise-reduction coefficient to be set to 0;

if the P(n) is greater than a third preset energy threshold, controlling a current feedforward noise-reduction coefficient to remain unchanged; and if the P(n) is between the second preset energy threshold and the third preset energy threshold, controlling a current feedforward noise-reduction coefficient to be reduced by one noise-reduction-coefficient preset value;

wherein the second preset energy threshold is less than the third preset energy threshold.

12. The earphone according to claim 7, the method further comprising:

determining a current scene mode at a preset time interval according to the spectrum information of the environmental-sound signal;

acquiring a feedback noise-reduction coefficient corresponding to the current scene mode; and performing feedback noise-reduction processing on an environmental-sound signal collected by a feedback microphone according to the feedback noise-reduction coefficient, and outputting a signal after being feedback noise-reduction processed.

* * * * *